United States Patent [19]

Kneisel et al.

[11] Patent Number: 4,942,435

[45] Date of Patent: Jul. 17, 1990

[54] SHEET FEEDING AND LEVELING APPARATUS

[75] Inventors: Charles S. Kneisel, Farmington; Kenneth B. Mahon, Rochester; Raymond A. Povio, Fairport, all of N.Y.

[73] Assignee: Xerox Corporation, Stamford, Conn.

[21] Appl. No.: 250,186

[22] Filed: Sep. 28, 1988

[51] Int. Cl.[5] ..... G03G 15/00; B65H 1/12

[52] U.S. Cl. ..... 355/311; 271/148

[58] Field of Search ..... 355/309, 311; 271/148, 271/160, 164; 414/795.6, 788.2

[56] References Cited

U.S. PATENT DOCUMENTS

| | | | |
|---|---|---|---|
| 2,471,066 | 5/1949 | Hesson | 271/148 |
| 2,886,314 | 5/1959 | Phelan | 271/148 |
| 4,593,895 | 6/1986 | Myers et al. | 271/148 |

FOREIGN PATENT DOCUMENTS

| | | | |
|---|---|---|---|
| 1341132 | 9/1987 | U.S.S.R. | 271/148 |

*Primary Examiner*—Joan H. Pendegrass

*Attorney, Agent, or Firm*—H. Fleischer; J. E. Beck; R. Zibelli

[57] ABSTRACT

An electrophotographic printing in which successive copy sheets are supplied from a supply source thereof. A tray is arranged to have a stack of copy sheets disposed thereon. When one marginal region of the stack of copy sheets has a greater thickness than the other marginal region, a support is interposed between the tray and the lowermost sheet of the stack of copy sheets so that at least the opposed marginal regions of the uppermost sheet of the stack of copy sheets are at substantially about the same level.

24 Claims, 3 Drawing Sheets

SHEET FEEDING AND LEVELING APPARATUS

This invention relates generally to an electrophotographic printing machine, and more particularly concerns a sheet feeding and leveling apparatus wherein a stack of copy sheets having opposed marginal regions of different thicknesses is supported such that the marginal regions of the uppermost sheet are at substantially about the same level.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a high speed commercial printing machine of the foregoing type, large volumes of copy sheets are fed from storage to the transfer station of the printing machine where the toner powder image is transferred to the copy sheet. Frequently, the copy sheets are stored on a elevator type of sheet feeding tray. The tray is mounted on a frame and moves vertically from a sheet loading to a sheet feeding position. High capacity printing machines require large amounts of copy sheets. For example, a fully loaded tray may be loaded with several reams of paper with each ream containing approximately five hundred sheets. The sheet feeder advances successive uppermost copy sheets from the stack of copy sheets mounted on the tray. Frequently, three hole paper is used as copy sheets. A copy sheet having holes punched therein is usually reinforced with a Mylar strip in the region of the holes. Thus, there is an additional thickness in the area of the Mylar reinforced strip. The marginal region of the copy sheet having the Mylar strip is thicker than the opposed marginal region. The copy sheets are loaded on the tray with the reinforced Mylar strip being the trail edge of the stack of copy sheets. This results in the trail edge of the stack of copy sheets being thicker than the leading edge of the stack of copy sheets. Under these circumstances, the leading edge of the stack of copy sheets is lower than the trailing edge thereof. For example, when a ream of copy sheets having reinforced Mylar strips is loaded on the tray the differential build up between the leading and trailing edges of the stack is approximately 12 to 13 millimeters per ream of copy sheets. This out of level condition results in significant sheet feeding problems, such as sheet stubbing, misfeeding and multifeeding.

Various approaches have been devised for leveling sheets. The following disclosures appear to be pertinent:

U.S. Pat. No. 2,471,066

Patentee: Hesson

Issued: May 24, 1949

U.S. Pat. No. 2,886,314

Patentee: Phelan

Issued May 12, 1959

U.S. Pat. No. 4,593,895

Patentee: Myers et al.

Issued: Jun. 10, 1986

The relevant portions of the foregoing patents may be summarized as follows:

U.S. Pat. No. 2,471,066 discloses a compensator mechanism for uneven thickness sheet feeding for use on a can labeler. A hinged section moves up or down to maintain the top of the stack level.

U.S. Pat. No. 2,886,314 describes a compensator mechanism for uneven thicknesses of paper. The mechanism uses a pair of compensator bars for raising the middle as well as one end of the stack to level the top.

U.S. Pat. No. 4,593,895 discloses a cash dispensing machine cassette having a stack of bills with their long lower edges supported on a floor when loaded in the cassette. A pair of resilient pushers engage the rear of the stack of bills to slide the bills into operative engagement with an ATM which discharges bills therefrom.

In accordance with one aspect of the present invention, there is provided an apparatus adapted to be mounted on a tray for supporting a stack of sheets wherein one marginal region of the stack has a greater thickness than the other marginal region of the stack. The apparatus includes means for fixedly supporting the other marginal region of the stack of sheets. Means are provided for resiliently supporting at least the marginal region of the stack of sheets having the greater thickness. The fixed supporting means and the resilient supporting means engage the lowermost sheet of the stack to support the stack of sheets so that at least the opposed marginal regions of the uppermost sheet of the stack are at substantially about the same level.

Pursuant to another aspect of the features of the present invention, there is provided an electrophotographic printing machine of the type having a latent image developed on a photoconductive member and in which the developed image is transferred to a copy sheet with successive copy sheets being supplied from a supply source thereof. The printing machine includes a tray arranged to have a stack of copy sheets disposed thereon. Means, adapted to be interposed between the tray and the stack of copy sheets when one marginal region of the stack of copy sheets has a greater thickness than the other marginal region thereof, supports the stack of copy sheets so that at least opposed marginal regions of the uppermost sheet of the stack of copy sheets are at substantially about the same level.

Still another aspect of the present invention provides a sheet feeding apparatus which includes a tray arranged to have a stack of sheets disposed thereon. Means, adapted to be interposed between the tray and the stack of copy sheets when one marginal region of the stack of sheets has a greater thickness than the other marginal region thereof, supports the stack of sheets so that at least opposed marginal regions of the uppermost sheet of the stack of sheets are at substantially about the same level. Means advance successive uppermost sheets from the stack of sheets.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
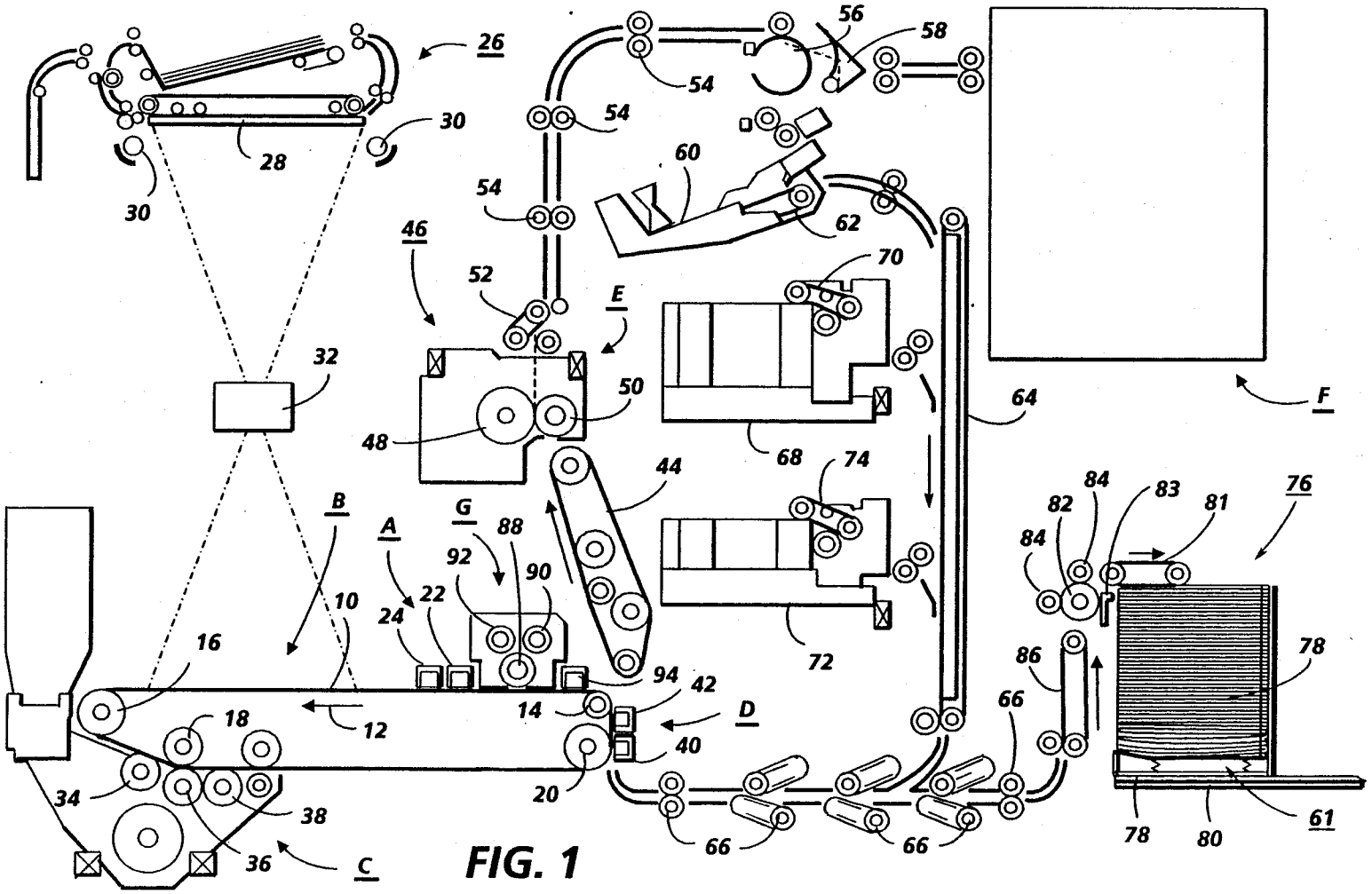
FIG. 1 is a schematic elevational view depicting an illustrative electrophotographic printing machine incorporating the sheet feeding apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the sheet feeding and leveling apparatus of the present invention may be employed in a wide variety of devices and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a selenium generator layer. The transport layer transports positive charges from the generator layer. The generator layer is coated on an interface layer. The interface layer is coated on the ground layer made from a titanium coated Mylar. The interface layer aids in the transfer of electrons to the ground layer. The ground layer is very thin and allows light to pass therethrough. Other suitable photoconductive materials, ground layers, and anti-curl backing layers may also be employed. Belt 10 moves in the direction of arrow 12 to advance successive portions sequentially through the various processing stations disposed about the path of movement thereof. Belt 10 is entrained about stripping roller 14, tensioning roller 16, idler roller 18, and drive roller 20. Stripping roller 14 and idler roller 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24 charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station B, a document handling unit, indicated generally by the reference numeral 26, is positioned over platen 28 of the printing machine. Document handling unit 26 sequentially feeds documents from a stack of documents placed by the operator face up in a normal forward collated order in the document stacking and holding tray. A document feeder located below the tray forwards the bottom document in the stack to a pair of take-away rollers. The bottom sheet is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the document stack through the feed roll pair. A position gate is provided to divert the document to the inverter or to the feed roll pair. Imaging of a document is achieved by lamps 30 which illuminate the document on platen 28. Light rays reflected from the document are transmitted through lens 32. Lens 32 focuses light images of the original document onto the charged portion of photoconductive belt 10 to selectively dissipate the charge thereon. This records an electrostatic latent image on the photoconductive belt which corresponds to the informational areas contained within the original document. Thereafter, belt 10 advances the electrostatic latent image recorded thereon to development station C.

Development station C has three magnetic brush developer rolls, indicated generally by the reference numerals 34, 36 and 38. A paddle wheel picks up developer material and delivers it to the developer rolls. When developer material reaches rolls 34 and 36, it is magnetically split between the rolls with half of the developer material being delivered to each roll. Photoconductive belt 10 is partially wrapped about rolls 34 and 36 to form extended development zones. Developer roll 38 is a cleanup roll. A magnetic roll, positioned after developer roll 38, in the direction of arrow 12, is a carrier granule removal device adapted to remove any carrier granules adhering to belt 10. Thus, rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly, indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F or to duplex tray 60. At finishing station F, copy sheets are stacked in a compiler tray and attached to one another to form sets. The sheets are attached to one another by either a binder or a stapler. In either case, a plurality of sets of documents are formed in finishing station F. When duplex solenoid gate 58 diverts the sheet into duplex tray 60. Duplex tray 60 provides an intermediate or buffer storage for those sheets that have been printed on one side and on which an image will be subsequently printed on the second, opposed side thereof, i.e. the sheets being duplexed. The sheets are stacked in duplex tray 60 face down on top of one another in the order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D. When copy sheets having Mylar reinforced strips are placed in tray 68, one marginal region of the stack will be thicker than the other marginal region. The leveling device of the present invention may be interposed between the lowermost sheet of the stack and the tray to maintain successive uppermost sheets substantially level.

Copy sheets may also be fed to transfer station D from the auxiliary tray 72. The auxiliary tray 72 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 and then to transfer station D. When copy sheets having Mylar reinforced strips are placed in tray 72, one marginal region of the stack will be thicker than the other marginal region. The leveling device of the present invention may be interposed between the lowermost sheet of the stack and the tray to maintain successive uppermost sheets substantially level.

Secondary tray 68 and auxiliary tray 72 are secondary sources of copy sheets. A high capacity feeder, indicated generally by the reference numeral 76, is the primary source of copy sheets. High capacity feeder 76 includes a tray 78 supported on an elevator 80. The elevator is driven by a bidirectional AC motor to move the tray up or down. In the up position, the copy sheets are advanced from the tray to transfer station D. When copy sheets having Mylar reinforced strips are placed in tray 78, one marginal region of the stack will be thicker than the other marginal region. The leveling device of the present invention, indicated generally by the reference numeral 61, may be interposed between the lowermost sheet of the stack and the tray to maintain successive uppermost sheets substantially level. A fluffer and air knife 83 direct air onto the stack of copy sheets to separate the uppermost sheet from the remaining copy sheets of the stack. A vacuum pulls the uppermost sheet against feed belt 81. Feed belt 81 feeds successive uppermost sheets from the stack to a take-away drive roll 82 and idler rolls 84. The drive roll and idler rolls guide the sheet onto transport 86. Transport 86 advances the sheet to rolls 66 which, in turn, move the sheet to transfer station D. Further details of the operation of high capacity feeder 76 will be described hereinafter with reference to FIG. 2.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected. Thus, when the operator selects the finishing mode, either an adhesive binding apparatus and/or a stapling apparatus will be energized and the gates will be oriented so as to advance either the simplex or duplex copy sheets to finishing station F. The detailed operation of high capacity feeder 76 will be described hereinafter with reference to FIG. 2.

Figure 2:
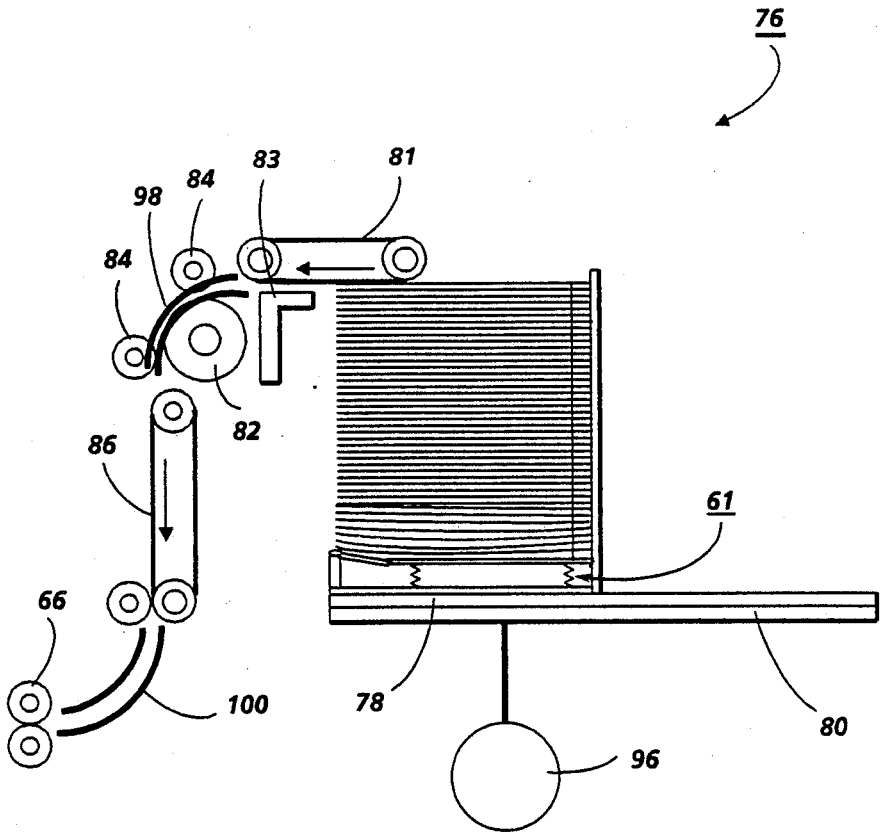
FIG. 2 is a schematic elevational view showing the sheet feeding apparatus used in the FIG. 1 printing machine.

Referring now to FIG. 2, the features of high capacity feeder 76 includes a tray 78 having leveling device 61 mounted thereon when the copy sheets have one marginal region thicker than the other marginal region. Tray 78 is supported on an elevator 80. Elevator 80 is driven by a bidirectional AC motor 96. Motor 96 drives elevator 80 to move tray 78 up and down. The stack of copy sheets are loaded on leveling device 61 with the trail edge being thicker than the leading edge, i.e. the trail edge includes the Mylar reinforced strip. The leveling device maintains the trailing and leading edges of successive uppermost sheets substantially level facilitating sheet feeding. Further details of leveling device 61 will be described hereinafter with reference to FIGS. 2 and 3. Air knife and fluffer 83 direct air onto the stack of copy sheets in the sheet feeding position. There are two fluffers blowing against the lead edge of the stack of copy sheets, and one fluffer blowing against the rear edge of stack of copy sheets. As the top sheet is separated from the remaining sheets in the stack, the vacuum pulls the top sheet against feed belt 81. The air knife is then used to separate the next copy sheet from the remainder of the sheets in the stack as the prior top copy sheet is advanced by feed belt 81 into baffle 98. Take away drive roller 82 cooperates with idler rollers 84 to move the sheet onto vertical transport 86. Transport 86 moves the sheet into baffle 100 which guides the sheet into the nip defined by roller pairs 66. As shown in FIG. 1, roller pairs 66 move the sheet to transfer station B.

Figure 3:
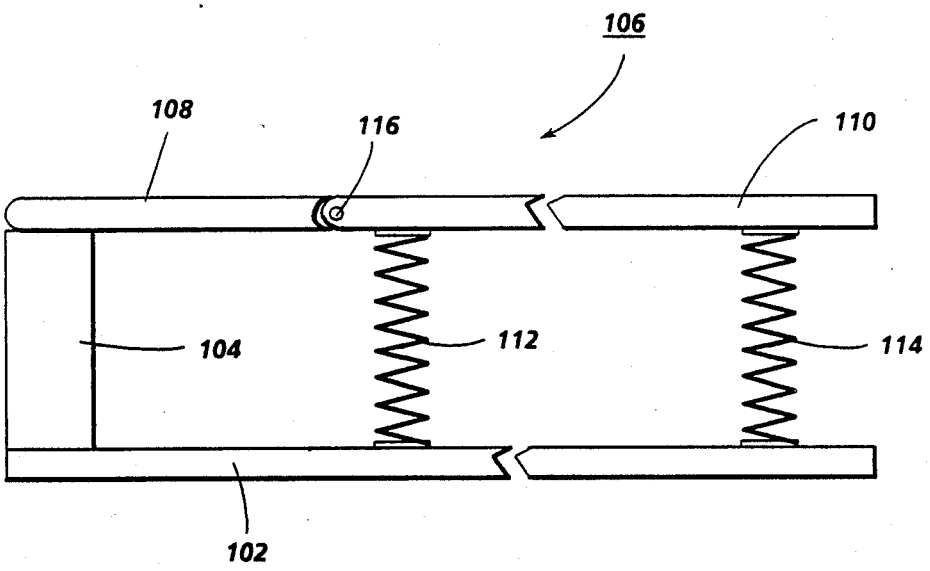
FIG. 3 is a schematic elevational view illustrating the unloaded stack leveling device used in the FIG. 2 sheet feeding apparatus.

Referring now to FIG. 3, leveling device 61 is depicted thereat without a stack of copy sheets loaded thereon, i.e. in the unloaded condition. Leveling device 61 includes a base plate 102 having a stop 104 extending upwardly from the surface thereof. A generally planar member, indicated generally by the reference numeral 106 has a first generally planar portion 108 pivotably connected to a second generally planar portion 110. Thus, portion 108 is hinged to portion 110 of generally planar member 106. A pair of spaced coil springs 112 and 114 are mounted on base plate 102 and support second portion 110 of generally planar member 106. Spring 114 is positioned in the region of the free end of second portion 110 with spring 112 being positioned in the region of the hinged end of second portion 110. Stop 104 is mounted on base plate 102 and extends upwardly therefrom. The free end of stop 104 supports the free end of first planar portion 108, i.e. the end opposed from the hinged end thereof. Second portion 110 moves downwardly under the weight of the stack of copy sheets. First portion 108 pivots about hinge 116. In this way, the trailing or thicker marginal region of the lowermost sheet is beneath the leading marginal region supported by the end of first portion 108 supported by stop 104. This levels the uppermost sheet of the stack so that the leading and trailing marginal portions thereof are at substantially about the same level. The foregoing is shown more clearly in FIG. 4.

Figure 4:
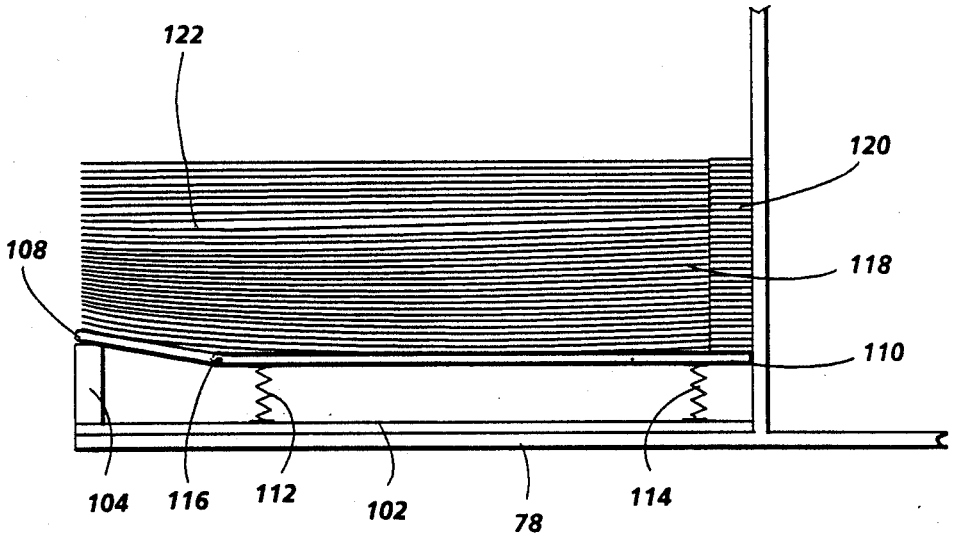
FIG. 4 is a schematic elevational view illustrating the loaded stack leveling device used in the FIG. 2 sheet feeding apparatus.

Turning now to FIG. 4, there is shown leveling device 61 with a stack of copy sheets 118 loaded thereon. The trailing marginal region 120 of each sheet has a strip of Mylar reinforcement on the upper surface thereof. Thus, the trailing marginal region 120 of the stack of copy sheets is thicker than the leading marginal region 122 thereof. The weight of the stack of copy sheets 118 being supported on second portion 110 causes springs 112 and 114 to compress. This lowers the trailing marginal region 120. In contradistinction, the leading marginal region 122 is supported on first portion 108 whose free end is supported fixedly by stop 108. Thus, the leading marginal end region remains fixed. Springs 112 and 114 are selected to have a spring constant which maintains the leading and trailing marginal regions of the uppermost sheet of the stack of copy sheets substantially level. Stop 104 is mounted on one end of base plate 102. Spring 114 is mounted on the other end of base plate 102 with spring 112 being mounted on base plate 102 intermediate stop 104 and spring 1114. First portion 108 of generally planar member 106 is connected by hinge 116 pivotably to second portion 118 thereof. As is shown in FIG. 4, first portion 108 pivots at hinge 116 as second portion 108 moves downwardly under the weight of the stack of sheets. This downward movement of the thicker trailing marginal region while the leading marginal region remains fixed insures that the leading and trailing marginal regions of the uppermost sheet of the stack remain substantially level.

One skilled in the art will appreciate that instead of using a spring mounted support for the thicker marginal region, a ratchet arrangement or a rack and opinion may be used wherein the support is moved down the requisite distance to insure that the leading and trailing marginal regions of the uppermost sheet of the stack of copy sheets are substantially level.

Alternatively, one skilled in the art will appreciate that a passive system may be used instead of a dynamic system. A passive system forms a cavity for the additional thickness of the trailing edge of the stack of sheets while maintaining the uppermost sheet substantially level. This may be achieved by placing a fixed shim beneath the leading marginal region of the stack of sheets. The thickness of the shim is sufficient to position the leading marginal region of the stack of sheets level with the trailing marginal region thereof. This system is passive in that it does not employ the springs of the dynamic system. A passive system of this type may be preferably used in secondary tray 68 and auxiliary tray 72.

In recapitulation, the sheet feeding and leveling apparatus of the present invention compensates for the differing thickness of the leading and trailing marginal regions of the stack of copy sheets to insure that the trailing and leading edges the uppermost sheet of the stack are substantially level. The leveling device is adapted to be inserted between the tray and lowermost sheet of the stack of copy sheets.

It is, therefore, evident that there has been provided, in accordance with the present invention, a sheet feeding and leveling apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. An apparatus adapted to be mounted on a tray for supporting a stack of sheets wherein one marginal region of the stack has a greater thickness than the other marginal region of the stack, including:

means for fixedly supporting the other marginal region of the stack of sheets; and spring means for resiliently supporting at least the one marginal region of the stack of sheets having the greater thickness, said fixed supporting means and said resilient supporting means engaging the lowermost sheet of the stack to support the stack of sheets so that at least the opposed marginal regions of the uppermost sheet of the stack are at substantially about the same level.

2. An apparatus according to claim 1, wherein said fixed supporting means includes a first generally planar member having at least the other marginal region of the stack of sheets mounted thereon.

3. An apparatus according to claim 2, wherein said spring means includes a second generally planar member having at least the marginal region of the stack of sheets having the greater thickness mounted thereon.

4. An apparatus according to claim 3, wherein one end of said first generally planar member is pivotably connected to one end of said second planar member, said one end of said first generally planar member and said one end of said second planar member being located intermediate the marginal regions of the stack of sheets.

5. An apparatus adapted to be mounted on a tray for supporting a stack of sheets wherein one marginal region of the stack has a greater thickness than the other marginal region of the stack, including:

means for fixedly supporting the other marginal region of the stack of sheets, said fixed supporting means includes a first generally planar member having at least the other marginal region of the stack of sheets mounted thereon, said fixed supporting means includes a stop supporting at least the other end of said first planar member; and means for resiliently supporting at least the one marginal region of the stack of sheets having the greater thickness, said fixed supporting means and said resilient supporting means engaging the lowermost sheet of the stack to support the stack of sheets so that at least the opposed marginal regions of the uppermost sheet of the stack are at substantially about the same level, said resilient supporting means includes a second generally planar member having at least the marginal region of the stack of sheets having the greater thickness mounted thereon with one end of said first generally planar member being pivotably connected to one end of said second planar member, said one end of said first generally planar member and said one end of said second planar member being located intermediate the marginal regions of the stack of sheets.

6. An apparatus according to claim 5, wherein said resilient supporting means includes at least a first spring supporting at least the other end of said second planar member.

7. An apparatus according to claim 6, wherein said resilient supporting means includes a second spring supporting at least the one end of said second planar member.

8. An apparatus according to claim 7, further including a base plate having said stop and said first and second springs mounted thereon.

9. An electrophotographic printing machine of the type in which a latent image is developed on a photoconductive member and the developed image transferred to a copy sheet with successive copy sheets being supplied from a supply source thereof, wherein the improvement includes:

a tray arranged to have a stack of copy sheets disposed thereon; and means, adapted to be interposed between said tray and the stack of copy sheets when one marginal region of the stack of copy sheets has a greater thickness than the other marginal region thereof, for supporting the stack of copy sheets so that at least opposed marginal regions of the uppermost sheet of the stack of copy sheets are at substantially about the same level, said supporting means comprises means for fixedly supporting the other marginal region of the stack of sheets, and spring means for resiliently supporting at least the one marginal region of the stack of sheets having the greater thickness, said fixed supporting means and said resilient supporting means engaging the lowermost sheet of the stack of copy sheets.

10. A printing machine according to claim 9, wherein said fixed supporting means includes a first generally planar member having at least the other marginal region of the stack of copy sheets mounted thereon.

11. A printing machine according to claim 10, wherein said spring means includes a second generally planar member having at least the marginal region of the stack of copy sheets having the greater thickness mounted thereon.

12. A printing machine according to claim 11, wherein one end of said first generally planar member is pivotably connected to one end of said second planar member, said one end of said first generally planar member and said one end of said second planar member being located intermediate the marginal regions of the stack of copy sheets.

13. An electrophotographic printing machine of the type in which a latent image is developed on a photoconductive member and the developed image transferred to a copy sheet with successive copy sheets being supplied from a supply source thereof, wherein the improvement includes:

a tray arranged to have a stack of copy sheets disposed thereon; and means, adapted to be interposed between said tray and the stack of copy sheets when one marginal region of the stack of copy sheets has a greater thickness than the other marginal region thereof, for supporting the stack of copy sheets so that at least opposed marginal regions of the uppermost sheet of the stack of copy sheets are at substantially about the same level, said supporting means comprises means for fixedly supporting the other marginal region of the stack of sheets, and means for resiliently supporting at least the one marginal region of the stack of sheets having the greater thickness, said fixed supporting means and said resilient supporting means engaging the lowermost sheet of the stack of copy sheets, said fixed supporting means includes a first generally planar member having at least the other marginal region of the stack of copy sheets mounted thereon, said resilient supporting means includes a second generally planar member having at least the marginal region of the stack of copy sheets having the greater thickness mounted thereon with one end of said first generally planar member being pivotably connected to one end of said second planar member, said one end of said first generally planar member and said one end of said second planar member being located intermediate the marginal regions of the stack of copy sheets said fixed supporting means includes a stop supporting at least the other end of said first planar member.

14. A printing machine according to claim 13, wherein said resilient supporting means includes at least a first spring supporting at least the other end of said planar member.

15. A printing machine according to claim 14, wherein said resilient supporting means includes a second spring supporting at least the one end of said second planar member.

16. A printing machine according to claim 14, further including a base plate having said stop and said first and second springs mounted thereon.

17. A sheet feeding apparatus, including:

a tray arranged to have a stack of sheets disposed thereon;

means, adapted to be interposed between said tray and the stack of copy sheets when one marginal region of the stack of sheets has a greater thickness than the other marginal region thereof, for supporting the stack of sheets so that at least opposed marginal regions of the uppermost sheet of the stack of sheets are at substantially about the same level, said supporting means comprises means for fixedly supporting the other marginal region of the stack of sheets, and spring means for resiliently supporting at least the one marginal region of the stack of sheets having the greater thickness; and means for advancing successive uppermost sheets from the stack of sheets.

18. A sheet feeding apparatus according to claim 17, wherein said fixed supporting means includes a first generally planar member having at least the other marginal region of the stack of sheets mounted thereon.

19. A sheet feeding apparatus according to claim 18, wherein said spring means includes a second generally planar member having at least the marginal region of the stack of sheets having the greater thickness mounted thereon.

20. A sheet feeding apparatus according to claim 19, wherein one end of said first generally planar member is pivotably connected to one end of said second planar member, said one end of said first generally planar member and said one end of said second planar member being located intermediate the marginal regions of the stack of sheets.

21. A sheet feeding apparatus, including:

a tray arranged to have a stack of sheets disposed thereon;

means, adapted to be interposed between said tray and the stack of copy sheets when one marginal region of the stack of sheets has a greater thickness than the other marginal region thereof, for supporting the stack of sheets so that at least opposed marginal regions of the uppermost sheet of the stack of sheets are at substantially about the same level, said fixed supporting means and said resilient supporting means engaging the lowermost sheet of the stack of sheets, said supporting means comprises means for fixedly supporting the other marginal region of the stack of sheets, and means for resiliently supporting at least the one marginal region of the stack of sheets having the greater thickness, said fixed supporting means and said resilient supporting means engaging the lowermost sheet of the stack of sheets, said fixed supporting means includes a first generally planar member having at least the other marginal region of the stack of sheets mounted thereon, said resilient supporting means includes a second generally planar member having at least the marginal region of the stack of sheets having the greater thickness mounted thereon with one end of said first generally planar member being pivotably connected to one end of said second planar member, said one end of said first generally planar member and said one end of said second planar member being located intermediate the marginal regions of the stack of sheets, said fixed supporting means includes a stop supporting at least the other end of said first planar member; and means for advancing successive uppermost sheets from the stack of sheets.

22. A sheet feeding apparatus according to claim 21, wherein said resilient supporting means includes at least a first spring supporting at least the other end of said second planar member.

23. A sheet feeding apparatus according to claim 22, wherein said resilient supporting means includes a second spring supporting at least the one end of said second planar member.

24. A sheet feeding apparatus according to claim 23, further including a base plate having said stop and said first and second springs mounted thereon.

* * * * *